US006427062B1

(12) United States Patent
Takeuchi

(10) Patent No.: US 6,427,062 B1
(45) Date of Patent: Jul. 30, 2002

(54) IMAGE FORMING APPARATUS WITH IMAGE TRANSFER TIMING BASED ON A DETECTION IMAGE

(75) Inventor: Akihiko Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/717,260

(22) Filed: Nov. 22, 2000

(30) Foreign Application Priority Data

Nov. 26, 1999 (JP) ..... 11-336778
Nov. 16, 2000 (JP) ..... 2000-349649

(51) Int. Cl.[7] ..... G03G 15/00

(52) U.S. Cl. ..... 399/388; 399/49; 399/72; 399/302

(58) Field of Search ..... 399/16, 34, 43, 399/71, 101, 264, 297, 302, 308, 343, 388, 391, 394, 49, 66, 72

(56) References Cited

U.S. PATENT DOCUMENTS 5,521,683 A 5/1996 Miyamoto et al. ..... 399/55
6,044,234 A * 3/2000 Yoshizawa ..... 399/49
6,091,913 A 7/2000 Suzuki et al. ..... 399/49
6,134,402 A * 10/2000 Nakayama et al. ..... 399/101
6,175,711 B1 * 1/2001 Yoshino et al. ..... 399/297
6,181,892 B1 * 1/2001 Fujimori ..... 399/72

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image forming apparatus includes an image bearing member for bearing an image, a transfer material bearing member for bearing and conveying a transfer material, wherein an image on the image bearing member is transferred onto the transfer material born on the transfer material bearing member at a transfer portion, a detector for detecting a detection image transferred from the image bearing member onto the transfer material bearing member, wherein the detection image conveyed to the transfer portion by the transfer material bearing member after being detected by the detector is transferred onto the image bearing member, and a controller for controlling a timing at which the transfer material is supplied to the transfer material bearing member on the basis of information with respect to the detection image when an image is continuously formed on a plurality of transfer materials.

38 Claims, 8 Drawing Sheets

IMAGE FORMING APPARATUS WITH IMAGE TRANSFER TIMING BASED ON A DETECTION IMAGE

BACKGROUND OF THE INVENTION

1. Field of the Invention

The present invention relates to an image forming apparatus using an electrophotographic method, and more particularly to an image forming apparatus such as a copying machine, a printer or a facsimile machine.

2. Related Background Art

FIG. 8 shows a schematic structure of an example of a process station (image forming station) in a conventional image forming apparatus using the electrophotographic method.

A process station 2 shown in FIG. 8 includes a photosensitive drum 21 that rotates in a direction indicated by an arrow R2 as an image bearing member. After the surface of the photosensitive drum 21 is uniformly charged by a primary charger 22, the surface receives an exposure 23' based on image information by an exposure device 23 such as an LED or a laser, to thereby form an electrostatic latent image thereon. Toner is stuck onto the latent image by a developing sleeve 27 of a developing device 24 which rotates in a direction indicated by an arrow R3, to thereby develop the latent image as a toner image. The toner image thus obtained is electrostatically transferred by a transfer charging blade 103 onto a transfer material P which is born on a conveying belt 1 and conveyed in a direction indicated by an arrow R1.

After the toner image has been transferred onto the transfer material P, non-transferred toner which has remained on the surface of the photosensitive drum 21 without being transferred onto the transfer material P is removed by a cleaning blade 25 and then collected within a waste toner container 26. The photosensitive drum 21 the surface of which has been thus cleaned is ready for succeeding image formation.

FIG. 9 shows a four-color full color image forming apparatus of a so-called in-line system in which four process stations having the same structure as that of the above-described process station 2 are arranged.

As shown in FIG. 9, in the image forming apparatus, a conveying belt 1 is disposed as transfer material conveying means, and the conveying belt 1 is put around four rollers consisting of an attractive opposite roller 6, a driving roller 7 and tension rollers 8 and 9, and rotated in a direction indicated by an arrow R1 by the drive of the driving roller 7. Four process stations 2*a*, 2*b*, 2*c* and 2*d* for yellow (Y), magenta (M), cyan (C) and black (K) are disposed tandem in the stated order from the upstream side along the moving direction of the conveying belt 1 as indicated by the arrow R1.

Transfer blades 103*a*, 103*b*, 103*c* and 103*d* are abutted against the conveying belt 1 in order to make the conveying belt 1 push with predetermined pressure toward photosensitive drums 21*a*, 21*b*, 21*c* and 21*d* within the respective process stations 2*a*, 2*b*, 2*c* and 2*d*. The respective transfer blades 103*a*, 103*b*, 103*c* and 103*d* are connected with transfer bias power supplies 104*a*, 104*b*, 104*c* and 104*d* each of which applies a transfer bias.

Up to now, the photosensitive drum 21 (21*a*, 21*b*, 21*c* and 21*d*) is made of negative organic photoconductor (OPC), and in the case where an exposed portion of the surface of the photosensitive drum 21 where negative electric charges are decayed by the exposure of the exposing device 23 is developed, a developer containing negative toner therein is employed. Accordingly, during transferring operation, a positive transfer bias is applied to the transfer blade 103 (103*a*, 103*b*, 103*c* and 103*d*) by the transfer bias power supplies 104 (104*a*, 104*b*, 104*c* and 104*d*). The transfer blade 103 is generally formed of a low-resistance resin film.

The transfer material P is conveyed from a sheet feed cassette 15 toward the conveying belt 1 by a feed roller 14. In order to make the transfer material P in synchronism with the toner image formed on the photosensitive drum, after the transfer material P thus conveyed is nipped by a pair of registration rollers 10 and 11 once, the transfer material P is conveyed in predetermined timing to an attractive portion N of the conveying belt 1 where an attractive roller 5 and an attractive opposite roller 6 are opposite to each other, and the transfer material P is attracted to the conveying belt 1 by the attractive roller 5 and the attractive opposite roller 6.

A given voltage is applied to the attractive roller 5 from an attractive bias power supply 12 which is a high voltage power supply, as a result of which electric charges are induced to the transfer material P, and the conveying belt 1 is dielectrically polarized, thereby allowing the transfer material P to be electrostatically attracted onto the surface of the conveying belt 1 so as to be firmly born by the surface of the conveying belt 1.

The transfer material P born on the conveying belt 1 sequentially passes through the respective transfer portions of the four process stations 2, and the toner images of the respective colors on the respective photosensitive drums 21*a*, 21*b*, 21*c* and 21*d* are sequentially superimposed and transferred on the transfer material P by the action of the transfer blade 103, to thus obtain a full color image of four colors on the transfer material P.

The transfer material P onto which the toner image of four colors has been thus transferred is separated from the conveying belt 1 and is then conveyed to a fixing device 16 where the transfer material P is heated and pressurized so that the toner image is fixed on the surface of the transfer material P, to thereby form a permanent image of the full color. Thereafter, the transfer material P is discharged to the external of the image forming apparatus. After electric charges are eliminated by a charge eliminating charger 13 from the surface of the conveying belt 1, from which the transfer material P has been separated, the conveying belt 1 is ready for a succeeding image forming process.

Up to now, the conveying belt 1 is formed of a resin film such as PVdF (polyvinylidene fluoride), ETFE (tetrafluoroethylene—ethylene copolymer), polyimide, PET (polyethylene terephthalate) or polycarbonate which is 50 to 200 $\mu$m in thickness and about $10^9$ to $10^{16}$ Ωcm in volume resistivity, or an urethane rubber in which fluorine resin such as PTFE is dispersed coated on a base layer made of rubber such as EPDM which is about 0.5 to 2 mm in thickness.

There is no case in which the conveying belt 1 is contaminated by the toner since the toner image is not directly transferred onto the surface of the conveying belt 1 during the normal image forming operation. However, in the case where the transfer material P is jammed or fogging toner on background is stuck onto a non-image portion of the photosensitive drum, the conveying belt 1 is contaminated by the toner. Also, in the case of executing a density control mode that controls the density of a toner image formed on the photosensitive drum or a registration control mode that controls a timing at which the toner images of the respective colors are formed on the respective photosensitive drums so as to appropriately superimpose the toner images of the respective colors on the transfer material P on each other, since a density patch or a register patch is transferred onto the conveying belt 1 as a detection toner image and then detected by a photosensor 31, the conveying belt 1 is contaminated by the toner by the density patch or the register patch.

The contamination toner on the conveying belt 1 is cleaned and removed by the cleaning blade 32 which is disposed opposite to a backup member 33 through the conveying belt 1. The removed toner is collected into a waste toner container 34.

Since the waste toner container 34 needs to be replaced by a fresh container when the container 34 is filled with the collected toner, this replacing work is troublesome for a user, as a result of which the useability may be lowered. Also, since the waste toner container 34 is so designed as to be replaceable, there arises such a problem that the structure of the main body of the image forming apparatus is complicated.

If the waste toner container 34 is made larger in sized in order to improve the useability, the main body of the apparatus is caused to be large in size in any case where the waste toner container 34 is fitted to a conveying belt unit having the conveying belt 1 or the main body of the apparatus.

In order to solve the above drawbacks, there has been proposed a cleaning system in which a cleaning bias is applied to the transfer blade 103 with no provision of a dedicated belt cleaner on the conveying belt 1 to electrostatically collect the contamination toner on the conveying belt to the photosensitive drum 21. In the image forming apparatus of the in-line system, since four photosensitive drums 21 are provided, there are four chances where the contamination toner on the conveying belt is collected, resulting in a very advantage.

When the contamination toner is removed, if the polarity of a voltage which is applied to the transfer blade 103 is made different among the respective process stations 2 to form a counter electric field in each of the stations, both of the positive contamination toner and the negative contamination toner can be collected, or if a supply voltage is made large to electrically charge the contamination toner on the conveying belt at a transfer portion, the contamination toner can be collected in a succeeding process station.

Up to now, the electric field cleaning operation is conducted at a timing different from that of a normal image forming sequence, for example, in a period between a time the image forming operation is completed and a time the image forming apparatus is suspended.

However, in the above-described image forming apparatus, when image formation is continuously conducted on a plurality of transfer materials, there may occur such a drawback that the hue or tone of a toner image (a change in density) formed on each of the transfer materials is changed, or misregister, that is, out-of-color registration occurs in the toner image of each color which is formed on each of the transfer materials.

Under the above circumstances, in order to solve the above drawback, an attempt has been made to form a density patch or a register patch on the conveying belt 1 between the adjacent transfer materials (so-called a space between sheets) even while the image formation is sequentially conducted on a plurality of transfer materials to execute the above-mentioned density control mode or the registration control mode. As a result, there occurs the following different problem.

In the image forming apparatus as shown in FIG. 9, since the density patch or the register patch formed on the conveying belt 1 is cleaned off by the cleaning blade 32 which is always abutted against the conveying belt 1, even in the case of continuously forming an image on the transfer material subsequent to the density control mode or the registration control mode, there is no case in which a back surface of the transfer material is contaminated by the patch toner image.

However, in the case where the above-mentioned electric field cleaning system is executed in a succeeding round of the conveying belt after the density patch or the register patch formed in a space between sheets on the conveying belt 1 is detected by a sensor 31 without using a mechanical cleaning system such as the cleaning blade 32 shown in FIG. 9, the density patch or the register patch on the conveying belt 1 is conveyed to the attractive portion N or the transfer portion of each process station. Therefore, in the case where the image is continuously formed on the transfer material subsequent to the density control mode or the registration control mode, there occurs such a problem that the back surface of the transfer material is contaminated by the patch toner image. In addition, this leads to such a problem that the attractive roller 5 is contaminated by the patch toner.

SUMMARY OF THE INVENTION

The present invention has been made to solve the above problems, and therefore an object of the present invention is to provide an image forming apparatus which controls a timing at which a transfer material is supplied to a transfer material bearing member so as not to superimpose a detection toner image on the transfer material, thereby being capable of preventing the back surface of the transfer material from being contaminated.

Another object of the present invention is to provide an image forming apparatus which controls a timing at which a toner image which is to be formed on the transfer material so as not to be superimposed on the detection toner image is formed on an intermediate transfer member, thereby being capable of preventing an image failure from occurring.

Other objects of the present invention will become apparent from the following detailed description.

BRIEF DESCRIPTION OF THE DRAWINGS

These and other objects, features and advantages of this invention will become more fully apparent from the following detailed description taken with the accompanying drawings in which.

DESCRIPTION OF THE PREFERRED EMBODIMENTS

Now, a description will be given in more detail of preferred embodiments of the present invention with reference to the accompanying drawings.

(First Embodiment)

Figure 1:
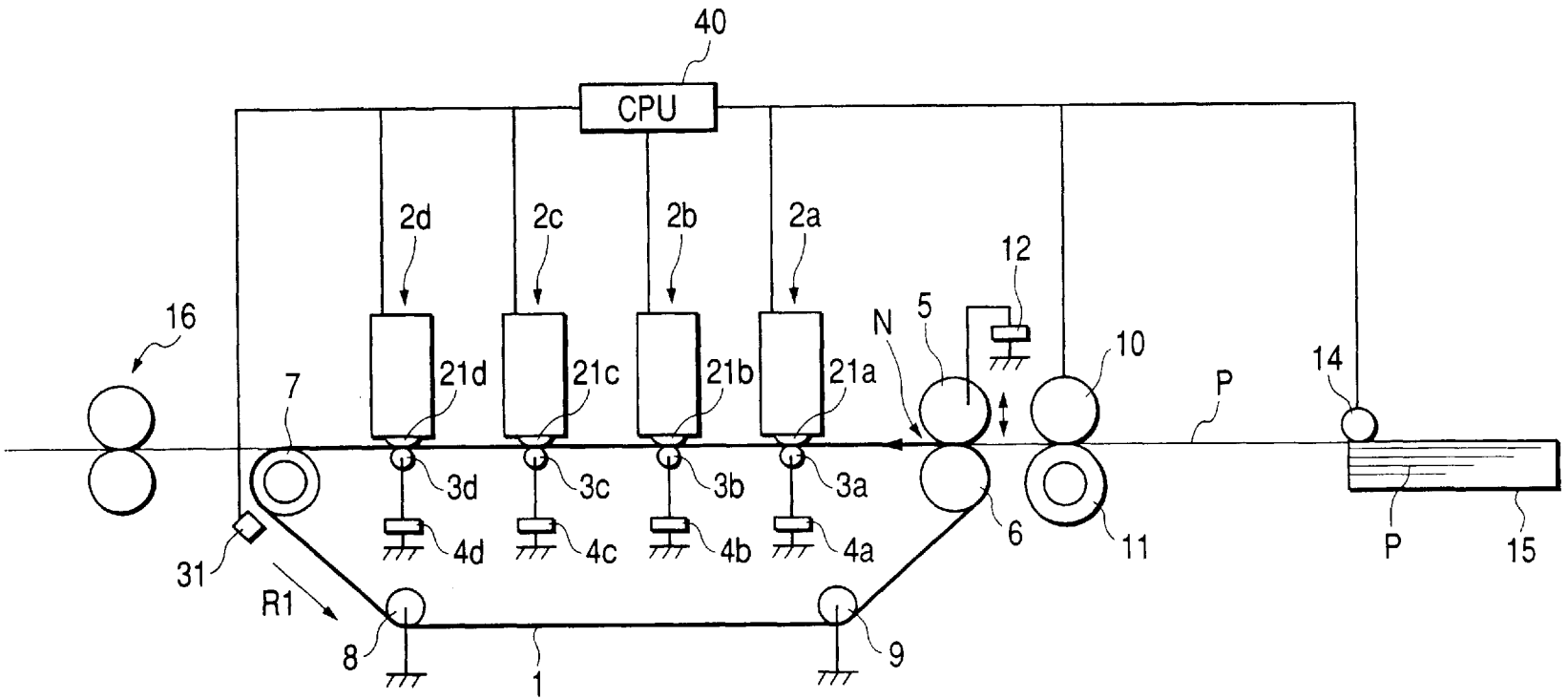
FIG. 1 is a schematic cross-sectional view showing an image forming apparatus in accordance with the present invention.

FIG. 1 is a schematic cross-sectional view showing an image forming apparatus in accordance with an embodiment of the present invention. An image forming apparatus according to this embodiment is directed to a four-color full color image forming apparatus of a so-called in-line system having four process stations each forming a toner image of a different color.

The image forming apparatus includes a conveying belt 1 as a transfer material bearing member, and the conveying belt 1 is put around four rollers consisting of an attractive opposite roller 6, a driving roller 7, tension rollers 8 and 9 and rotatably moved in a direction indicated by an arrow R1 by the rotation of the driving roller 7. Four process stations (image forming stations), that is, a first station 2*a* of black (K), a second station 2*b* of magenta (M), a third station 2*c* of cyan (C) and a fourth station 2*d* of yellow (Y) are arranged tandem above the conveying belt 1 from an upstream side toward a downstream side along the rotating direction of the conveying belt 1.

The transfer material P supplied from a sheet feeding cassette 15 by a feed roller 14 and a pair of registration rollers 10 and 11 is born on a front surface of the conveying belt 1 and sequentially conveyed to the first to fourth process stations 2*a* to 2*d* by the rotation of the conveying belt 1 in the direction indicated by the arrow R1.

Upon receiving a sheet feed signal from a CPU 40 which is control means, the feed roller 14 picks up the transfer material P from the sheet feeding cassette 15 and conveys the transfer material P to the pair of registration rollers 10 and 11. Thereafter, the transfer material P is stopped once by the pair of registration rollers 10 and 11. Then, upon receiving a transfer material conveying start signal from the CPU 40 so as to synchronize with the image forming operation in the process stations 2*a* to 2*d*, the pair of registration rollers 10 and 11 start to rotate so as to supply the transfer material to the conveying belt.

The transfer material supplied to the conveying belt is electrostatically attracted onto the conveying belt 1 at the attractive portion N. At the attractive portion N, an attractive roller 5 which is an attractive member and an attractive opposite roller 6 which is an attractive opposite member are disposed opposite to each other through the conveying belt 1, and the conveying belt 1 and the transfer material P are nipped by the attractive roller 5 and the attractive opposite roller 6 when the transfer material P is attracted. Upon receiving an attraction start signal from the CPU, an attractive bias power supply 12 starts to apply an attractive bias voltage of about 1.5 kV to the attractive roller 5, and upon receiving an attraction completion signal, the attractive bias power supply 12 stops the supply of the attractive bias voltage.

In the respective first to fourth process stations 2*a* to 2*d*, the toner images of the respective colors are formed using the electrophotographic method. The respective process stations 2*a* to 2*d* are identical in structure with the process station 2 described above with reference to FIG. 8. Hereinafter, FIG. 8 is referred to if necessary.

Each the process station 2 (2*a*, 2*b*, 2*c* and 2*d*) has a photosensitive drum 21 (21*a*, 21*b*, 21*c* and 21*d*) as an image bearing member, which is a drum-shaped electrophotographic photosensitive member, and the photosensitive drum 21 may be formed of, for example, an OPC (organic photoconductor) photosensitive member of a negative charge characteristic.

Figure 8:
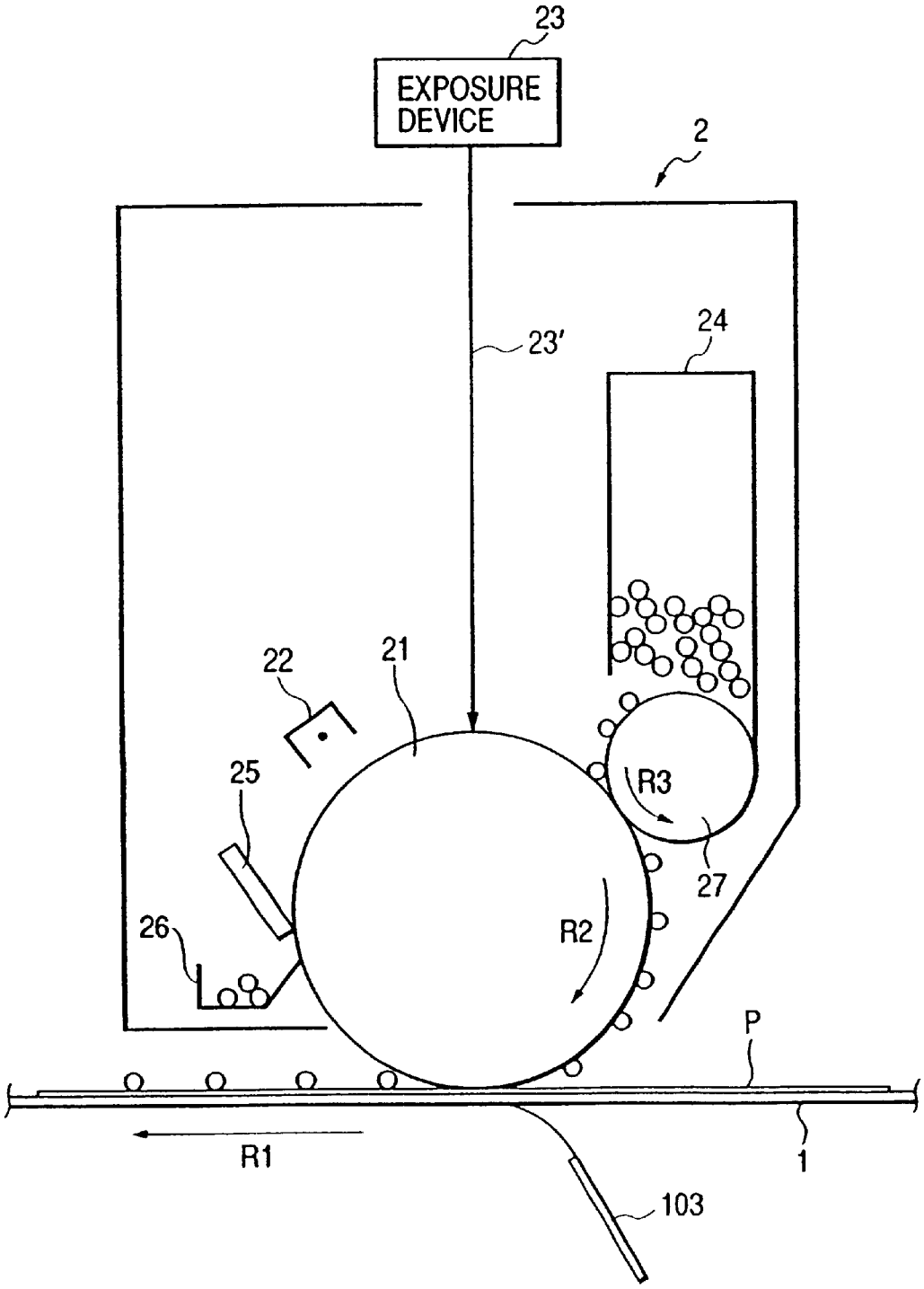
FIG. 8 PRIOR ART
FIG. 8 is a cross-sectional view showing a process station in the image forming apparatus.
Figure 9:
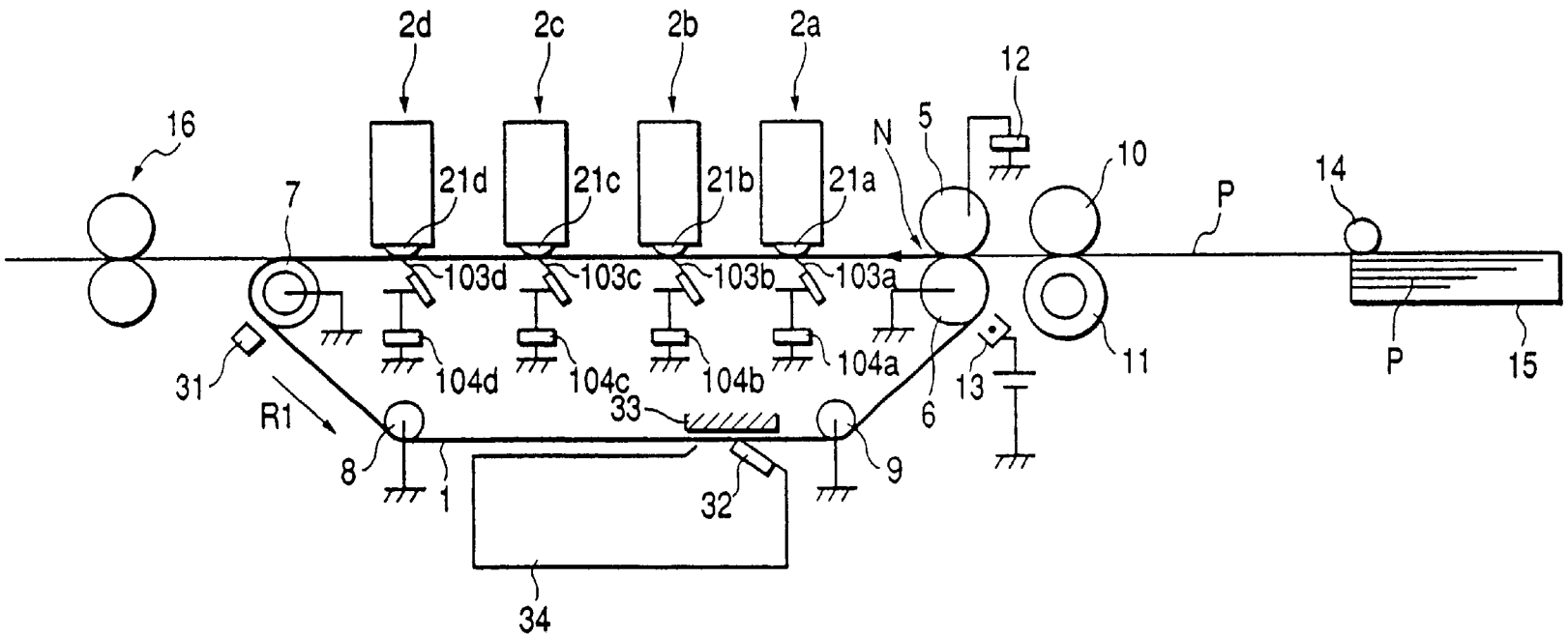
FIG. 9 PRIOR ART
FIG. 9 is a schematic cross-sectional view showing a conventional image forming apparatus.

The photosensitive drum 21 is rotatably supported and the surface of the photosensitive drum 21 is uniformly charged at substantially −600 V by a primary charger 22 shown in FIG. 8. In this embodiment, the image is formed at a process speed of about 100 mm/sec. The surface of the photosensitive drum 21 which has been electrically charged is subjected to an exposure 23' responsive to image information by an exposing device 23, and electric charges on the exposed portion is decayed to about −150 V, to thereby form an electrostatic latent image.

The electrostatic latent image of −150 V on the photosensitive drum 1 is developed by a developing device 24. The developing device 24 sticks minus toner born on the developing sleeve 24*a* as a thin layer to the latent image on the photosensitive drum 21, that is, develops the latent image with toner through a reversal development to form a toner image.

Developing devices 24 in the respective process stations 2*a*, 2*b*, 2*c* and 2*d* contain developer of yellow, magenta, cyan and black, and toner images of yellow, magenta, cyan and black are formed on the photosensitive drums 21*a*, 21*b*, 21*c* and 21*d* through development.

This embodiment uses a mono-component contact development in which the developing device 24 has an elastic layer on the surface of the developing sleeve 27 and rotates the developing sleeve 27 with respect to the photosensitive drum 21 at a speed of 180% in a forward direction while the developing sleeve 27 is abutted against the photosensitive drum 21 and develops the electrostatic latent image. The developing bias applied to the developing sleeve 27 is set to about −400 V.

As shown in FIG. 1, transfer rollers 3 (3*a*, 3*b*, 3*c* and 3*d*) as transfer means that abuts the conveying belt 1 against the respective photosensitive drums 21 at a given pressure are disposed on the respective transfer portions at the lower portions of the respective photosensitive drums 21. Those transfer rollers 3 are connected with transfer bias power supplies 4 (4*a*, 4*b*, 4*c* and 4*d*), and upon receiving a transfer start signal from the CPU, the transfer bias power supplies 4 (4*a* to 4*d*) apply the transfer bias (plus) to the transfer rollers 3 (3*a* to 3*d*). As a result, the toner image (minus) on the photosensitive drum 21 is transferred onto the transfer material P. In this embodiment, +1000 V, +1250 V, +1500 V and +1750 V are applied to the transfer rollers 3*a*, 3*b*, 3*c* and 3*d* as the transfer bias, respectively.

While the transfer material P thus attracted and born on the surface of the conveying belt 1 is conveyed at substantially the same speed as the peripheral speed of the photosensitive drums 21*a* to 21*d*, the toner images on the photosensitive drums 21*a* to 21*d* are sequentially transferred onto the transfer material P, to thus obtain a color image where toner images of four colors are superimposed on each other on the transfer material P. The transfer material P onto which the toner images of four colors are superimposedly transferred is thereafter heated and pressurized by a fixing device 16, and the toner images of four colors are fused and bonded on the surface of the transfer material P, to thus form a full color image of four colors.

On the other hand, the non-transferred toner which remains on the surface of the photosensitive drum 21 from which the toner image has been transferred without being transferred to the transfer material P is scraped off by the cleaning blade 25 shown in FIG. 8 and is ready for succeeding image formation. The toner thus scraped off is collected into the waste toner container 26 for the photosensitive drum.

According to the present inventor's study, it is preferable that the conveying belt 1 is excellent in the transfer material attractivity and the image transfer property and has an appropriate electric self-decay property so as to prevent charge-up even if no charge eliminating means is provided. In order to provide the above performances, in the case where the conveying belt 1 is formed of a resin belt, it is proper to employ a resin film such as PVdF, ETFE, polycarbonate, PET or polyimide which is about 50 to 200 $\mu$m in thickness and adjusted in volume resistivity to about $10^7$ to $10^{13}$ Ωcm. Since a fluorine resin film such as PVdF or ETFE among them is excellent in mold release property and difficult to stick a stain to the surface thereof, the film is particularly preferable.

As a method of adjusting the volume resistivity to a desired value, an ion conductive method of adding metallic salt or the like which is an ion conductive material is preferable from the viewpoints of the resistance stability and the leak resistance (pin hole prevention) during manufacture.

As the metallic salt, inorganic metallic salt which is made of alkali metal and anion (negative ion) such as LiCl, LiF, CsCl, CsF, KCl, KF or $LiClO_4$ and small in ion dissociation energy is preferably employed. Organic metal salt containing perfluoro alkyl group may be employed. Plural arbitrary kinds of those metallic salts may be combined together or a small amount of ZnO, $SnO_2$, $TiO_2$, carbon black or the like may be added to the above combination to the degree which does not prevent the effect of the present invention.

In this embodiment, the conveying belt 1 is formed of an endless belt manufactured by using a film which is about $10^9$ Ωcm in volume resistivity and 120 $\mu$m in thickness where metallic salt such as CsCl is blended with PVdF resin. The conveying belt 1 is set to be about 240 mm in width and about 760 mm in peripheral length.

Also, the attractive roller 5 is formed of a roller obtained by forming EPDM (ethylene-propylene-diene ternary copolymer) rubber 3 mm in thickness into which carbon is dispersed to adjust the volume resistivity to $10^5$ Ωcm or less on a mandrel 6 mm in diameter. According to the present inventors' study, it is preferable that the volume resistivity of the attractive roller 5 is set to $10^4$ to $10^{10}$ Ωcm.

The transfer roller 3 is formed of a roller obtained by forming EPDM rubber 2.5 mm in thickness into which carbon is dispersed to adjust the volume resistivity to $10^5$ Ωcm or less on a mandrel 5 mm in diameter. According to the present inventors' study, it is preferable that the volume resistivity of the transfer roller 3 is set to $10^2$ to $10^9$ Ωcm, and desirably set to be smaller than the volume resistivity of the conveying belt 1 as used.

The volume resistivities of the respective members such as the above-mentioned conveying belt 1 or the attractive roller 5 are obtained by normalizing a value measured by a high ohm-meter R8340 manufactured by ADVANTEST Co. with application of 100 V using a measuring probe that complies with JIS method K6911 by the respective thicknesses of the conveying belt 1, the attractive roller 5 and so on.

The attractive opposite roller 6 is formed of a metal roller on a bearing portion of which an insulating member is disposed so as to be electrically in a float state, and a registration roller 10 is grounded. The driving roller 7 is structured by forming a rubber layer for prevention of slippage which is about 0.5 to 3 mm in thickness on a metal mandrel. As the rubber layer, an insulating type $10^{15}$ Ωcm or more in resistance is used as one example. However, a low resistance type may be also employed.

The tension rollers 8 and 9 are formed of metal rollers. The mandrels of the tension rollers 8 and 9, and the driving roller 7 may be grounded or in a float state since the conveying belt 1 per se is of the self-decay property and no members (electrodes) which are opposite to each other through the conveying belt 1 exists.

Subsequently, the operation of cleaning the conveying belt 1 will be described.

In the image forming apparatus according to this embodiment, during the normal image forming operation, the conveying belt is not contaminated by the toner because the toner image is transferred onto the transfer material. However, in the case where the image formation is conducted although the transfer material is not conveyed due to jamming of the transfer material to transfer the toner image onto the conveying belt, or in the case where a designated transfer material is not suited to the size of the image, there is a case in which the image on the conveying belt is transferred as it is, and the conveying belt is contaminated by the toner.

Also, as described above, there are the density control mode for controlling the densities of the toner images formed on the respective photosensitive drums (adjusting at least one of a developing bias, a primary charging bias and the amount of exposure) to prevent the density variation, and the registration control mode for controlling a timing at which the toner images (electrostatic latent images) are formed on the respective photosensitive drums (controlling the above timing so that the toner images of the respective colors are registered with each other on the transfer material) to prevent out-of-color registration. In the case of executing the density control mode or the registration control mode, after the density patch or the register patch are transferred directly onto the conveying belt 1, and those patches are detected by a photosensor 31, those patches are conveyed onto the respective transfer portions of the respective process stations by the conveying belt 1.

The above-mentioned density control mode and registration control mode are so set as to be executed every time images are formed on a given number of transfer materials. Also, under the condition where the density fluctuates or under the condition where out-of-color registration occurs, the above-mentioned modes may be sequentially executed.

In this embodiment, no conventional cleaning means dedicated to the conveying belt 1 is provided, and there is applied an electric field cleaning system in which a cleaning bias is applied to the transfer rollers 3 (3*a* to 3*d*), the contamination toner on the conveying belt 1 (toner image which has been caused to be transferred onto the conveying belt during jamming, etc.) is electrostatically shifted onto the respective photosensitive drums, and the conveying belt 1 is cleaned. Accordingly, the density patch or the register patch which is conveyed onto the respective transfer portions through the conveying belt after being detected by the photosensor 31 is also electrostatically counter-transferred onto the respective photosensitive drums from the conveying belt by the respective transfer rollers.

In this embodiment, the electric field cleaning can be executed even during the normal printing operation for one transfer material or even during continuous printing operation for a plurality of transfer materials. However, since the contamination toner that occurs during the above-described normal printing operation is relatively little, a cleaning sequence of the conveying belt 1 is separately provided and started to conduct the electric field cleaning operation of the conveying belt 1 except for a case of jamming or executing the density control mode or the registration control mode. The electric field cleaning operation may be executed during afterrotation until the image forming apparatus stops after the print job (after the completion of the image formation).

According to this embodiment, in the cleaning sequence, the attractive roller 5 is isolated from the conveying belt 1, a cleaning bias of minus voltage is applied to the transfer rollers 3*a* and 3*c* of the first and third process stations 2*a* and 2*c*, and a cleaning bias of plus voltage is applied to the transfer rollers 3*b* and 3*d* of the second and fourth process stations 2*b* and 2*d* to rotate the conveying belt 1 by one revolution, thereby completely collecting the contamination toner of both polarities consisting of the plus polarity toner and the minus polarity toner which remain on the conveying belt 1.

In this example, +1.5 kV is applied to the plus side transfer rollers 3*b* and 3*d* as the cleaning bias and −1.5 kV is applied to the minus side transfer rollers 3*a* and 3*c*, and the photosensitive drums 21*a* to 21*d* are electrically eliminated to 0 V during the cleaning sequence (the surface of the photosensitive drum when at least the contamination toner on the conveying belt exists on the transfer portion is set to 0 V).

In this embodiment, after five density patch patterns of 10 mm×10 mm are formed on the conveying belt 1 for each of yellow, magenta, cyan and black, the sequence of the above electric field cleaning is executed. As a result, the toner that constitutes the density patch on the transfer belt 1 is shifted to the photosensitive drum 21 and collected so that the contamination toner can be excellently removed from the surface of the conveying belt 1. The contamination toner collected on the respective photosensitive drums 21 is finally collected into the waste toner containers 26 of the respective photosensitive drums 21.

Subsequently, a description will be given of the operation of cleaning the density patch and the register patch in the case of executing the density control mode or the registration control mode during the operation of continuously forming an image on a plurality of transfer materials.

In the case of executing the above modes, the CPU controls a timing at which the electrostatic latent image corresponding to the density patch or the register patch is formed on the photosensitive drum so that the density patch or the register patch is transferred onto the conveying belt 1 between the adjacent transfer materials born on the conveying belt 1. The CPU controls the above timing (the latent image formation start timing corresponding to the patch) on the basis of an image formation start signal (or an image formation completion signal) of the toner image which is to be formed on a former transfer material of the adjacent transfer materials on the conveying belt. A signal that serves as a trigger of the above timing may be also another signal.

Thereafter, after the density patch or the register patch on the conveying belt 1 is detected by the photosensor 31, the density patch or the register patch is conveyed onto the respective transfer portions by the conveying belt in a succeeding revolution and then cleaned. Therefore, in this embodiment, a timing at which a succeeding transfer material is supplied to the conveying belt is controlled by the CPU so that the density patch or the register patch on the conveying belt is not superimposed on the succeeding transfer material. A period of time that elapses since the latent image corresponding to the density patch or the register patch starts to be formed on the photosensitive drum is measured by a timer as measuring means. The CPU controls the pick-up timing of the transfer material by a pick-up roller 14 and the conveying start (rotation start) timing of the transfer material by the registration rollers 10 and 11 on the basis of the measured period of time, to thereby control the supply timing of the transfer material. As a result, the back surface of the transfer material can be prevented from being contaminated by the density patch or the register patch.

Figure 2:
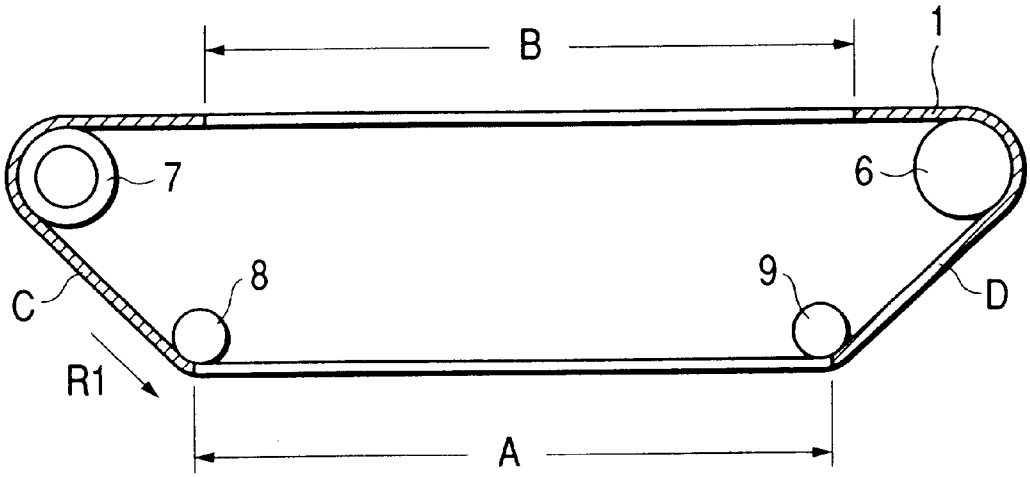
FIG. 2 is an explanatory diagram showing printable areas and spaces between sheets in which patches are formed on a conveying belt.

FIG. 2 shows printable areas A and B (areas on which the transfer material is born) and spaces C and D between sheets (areas on which the transfer material is not born) where the density patches are formed, on the conveying belt 1 during the continuous printing operation. When transfer materials of size A4 are born on the areas A and B in the sheet conveying direction and conveyed on the conveying belt 1 about 760 mm in peripheral length, the areas C and D between sheets which are respectively about 83 mm in length are produced before and after the transfer material. In this embodiment, the density patches are transferred and formed in the areas C and D, and the density is detected to conduct the density control.

Figure 3:
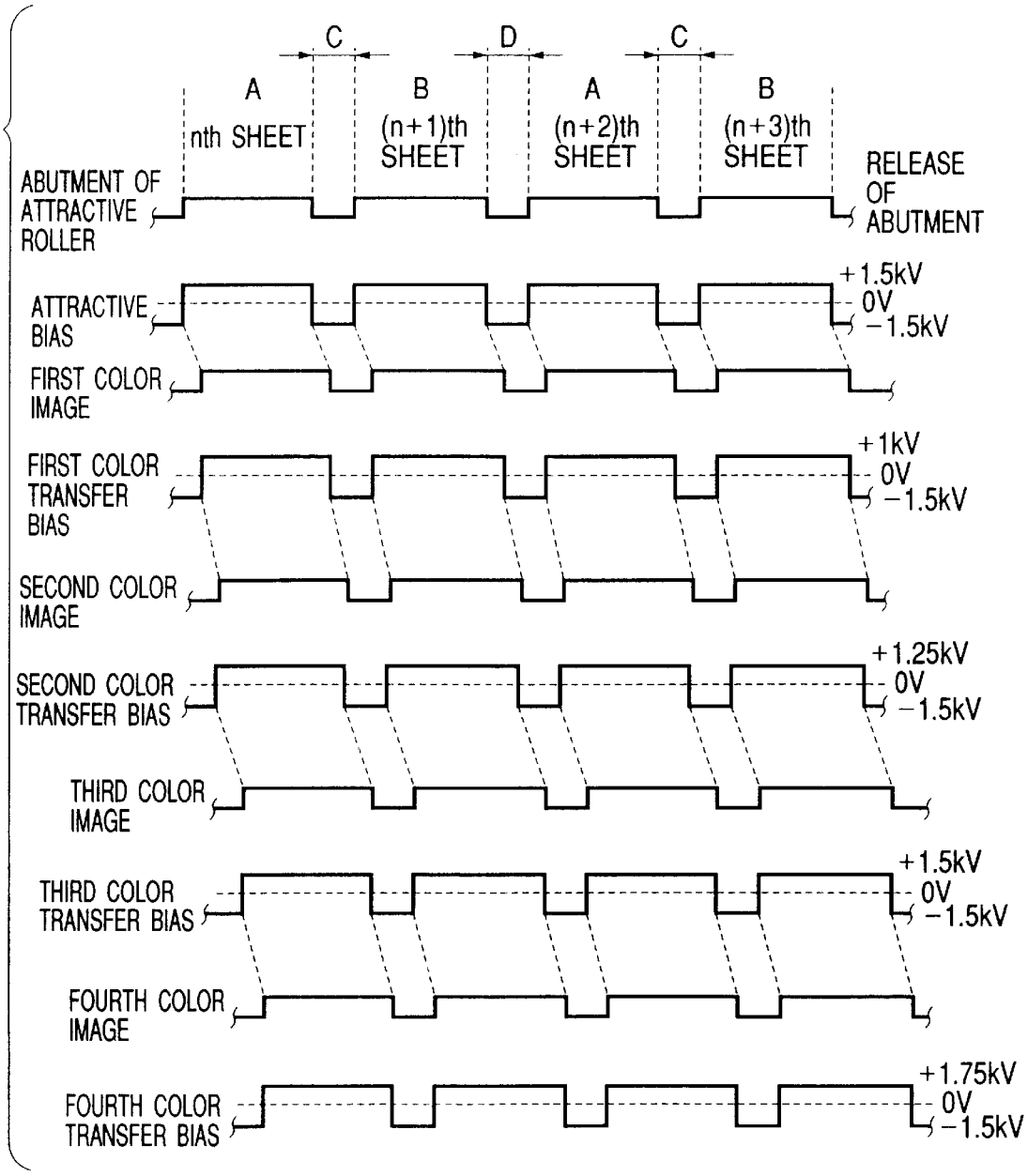
FIG. 3 is a timing chart showing the operation sequence of the respective process means when a patch is electric-field-cleaned off.

The operation sequence of the respective process means will be described with reference to FIG. 3. It is assumed that the transfer materials born on the area A of the conveying belt are an n-th sheet, an (n+2)th sheet, . . . , and the transfer materials born on the area B of the conveying belt are an (n+1)th sheet, an (n+3)th sheet, As shown in FIG. 3, the abutment and separation of the attractive roller 5 is controlled by the CPU so as to synchronize with the conveyance of the transfer material (when the transfer material passes through the attractive portion, the transfer material is moved so as to be nipped by the conveying belt, and after passing through the attractive portion, the transfer material is separated from the conveying belt). Also, an attractive bias=+1.5 kV is applied to the attractive roller 5 during the attracting operation and a bias=−1.5 kV for prevention of the density patch from being stuck is applied to the attractive roller 5 when the density patch passes through the attractive portion while the bias is changed over by the CPU. Then, a transfer bias=+1 kV is applied from the power supply 4*a* to the transfer roller 3*a* when an image of a first color is transferred and a cleaning bias=−1.5 kV is applied from the power supply 4*a* to the transfer roller 3*a* when the density patch is counter-transferred to the photosensitive drum while the bias is changed over by the CPU.

Hereinafter, the same is applied to the second, third and fourth colors so that the transfer bias=+1.25 kv, +1.5 kv, +1.75 kV and the cleaning bias=−1.5 kV are sequentially applied while being changed over by the CPU.

With the above operation, even in the image forming apparatus having no conventional cleaning means dedicated to the conveying belt according to this embodiment, the patches can be excellently electric-field cleaned without lowering the through-put of the image formation and without contaminating the back surface of the transfer material, even while the image is sequentially formed on a plurality of transfer materials, that is, even if the density patches or the register patches are formed in spaces between sheets on the conveying belt.

The above embodiment is described assuming that the printable areas A, B and the areas C and D between sheets are arranged at fixed positions. However, since the conveying belt is formed of an endless belt of seamless, the positions of the areas A and B are variable, and the transfer material can be born at any positions of the conveying belt in the moving direction. Also, the number of transfer materials which can be born on the conveying belt in the peripheral length of the conveying belt is variable depending on the length of the transfer material in the conveying direction, and if the length of the transfer material is shorter, the conveying belt can bear three, four, . . . transfer materials in order to improve the through-put of the image formation.

In addition, the above embodiment is described with reference to an example in which the image is continuously formed on a plurality of transfer materials (size A4) identical in size. However, the present invention is not limited to this example. For example, the present invention is applicable to a case in which one image formation start signal is inputted to the image forming apparatus from a personal computer through a connection cable, or one image formation start signal is inputted to the image forming apparatus from a display section disposed on a top surface of the image forming apparatus, to continuously form the images on a plurality of transfer materials different from each other in the length in the transfer material conveying direction. The present invention is not limited to the above structure but applied to the above embodiment, and it is preferable that the CPU controls the timing at which the transfer material is supplied to the conveying belt so that the patch and the transfer material are not superimposed on each other on the conveying belt on the basis of information on the length of the transfer material in the conveying direction and a period of time measured by the above timer. With the above structure, it is effective when the patches are formed on both of the areas C and D shown in FIG. 3.

In the above embodiment, the CPU estimates the position of the patch on the conveying belt on the basis of the period of time measured by the timer and conducts the control. However, the present invention is not limited to this structure. For example, the patch on the conveying belt is directly detected by the sensor or the like, and the timing at which the transfer material is supplied to the conveying belt may be controlled by the CPU on the basis of the timing at which the patch passes through the sensor section (a given position). Also, the timing at which the transfer material is supplied to the conveying belt may be controlled by the CPU on the basis of the timing at which the patch passes through the sensor section and the position information on the home position of the conveying belt which is known in advance. With the above structures, the position of the patch on the conveying belt can be surely recognized. Accordingly, when the patch on the conveying belt is conveyed onto the transfer portion for cleaning, the timing at which the transfer material is supplied to the conveying belt can be surely controlled so that the patch and the transfer material are surely prevented from being superimposed on each other. The sensor that detects the position of the patch on the conveying belt may be replaced by the above photosensor 31. With this structure, the number of parts as used is reduced, thereby being capable of downsizing the image forming apparatus and reducing the costs.

Also, in the case where uneven rotation exists in the photosensitive drum or the conveying belt due to the eccentricity of the photosensitive drum or the eccentricity of the driving roller, when the timing at which the transfer material is supplied to the conveying belt is controlled on the basis of the detected result by the above timer, the uneven rotations of the photosensitive drum and the conveying belt adversely affect the detected result. On the contrary, when the timing at which the transfer material is supplied to the conveying belt is controlled on the basis of the timing at which the patch on the conveying belt passes through the sensor section, since the uneven rotation of the conveying belt adversely affects the detected result, the latter is preferable from the viewpoint of the precision of the detected result. However, in the case where the sensor is contaminated by the toner to deteriorate the precision in detection (the precision in the detection of the timing at which the patch passes through the sensor section), the former is preferable. Under the circumstances, a case of controlling the timing at which the transfer material is supplied to the conveying belt on the basis of the detected result by the timer and a case of controlling the timing at which the transfer material is supplied to the conveying belt on the basis of the timing at which the patch on the conveying belt passes through the sensor section may be appropriately changed over by the CPU to conduct the control.

Figure 4:
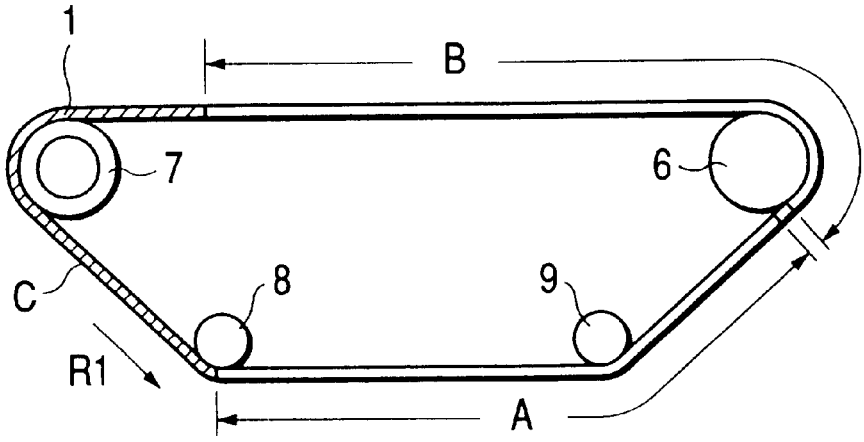
FIG. 4 is an explanatory diagram showing the printable areas and the spaces between sheets in which the patches are formed on the conveying belt when the peripheral length of the conveying belt is short.

Also, in the case where the length of the transfer material in the conveying direction is longer than the transfer material of the size A4, as shown in FIG. 4, the printing of an n-th sheet is executed in the printable area A, the density patch is formed in the area C between the printable area A and the subsequent printable area B, the printing of an (n+1)th sheet is executed in the printable area B, and the printing of an (n+2) sheet is executed in the printable area B after one revolution.

In this case, as compared with the method shown in FIG. 2, although the number of printing sheets is deteriorated by the execution of the detection of the density patch or the register patch, if the frequency of the detection is, for example, about once per 10 to 20 sheets, the deterioration of the number of printing sheets is slight, and there arises no problem in the practical use.

In the above example, the cleaning bias during the continuous printing operation is set to −1.5 kV in all of the sheets of the first color to fourth color. However, the toner of both polarities of plus and minus may be collected, for example, by applying −2 kV in the first and third colors and +1 kV in the second and fourth colors. The reason that the cleaning bias values of plus and minus are different from each other is because the surface potentials of the respective photosensitive drums between sheets is set to about −600 V.

Also, the attractive roller 5 can omit the release operation or omit the application of the contamination prevention bias. As the attractive bias of the attractive roller 5, the minus polarity (about −1.5 kV) can be employed. In this case, since the application of the attractive bias=−1.5 kV prevents the contamination, an additional contamination prevention bias does not need to be provided, thereby being capable of downsizing the attractive power supply and reducing the costs.

Also, it is needless to say that, in the case where the length between sheets is limited, the density patches or the register patches may be formed for each of the colors or only parts of the density patches or the register patches may be formed without all of the density patches or the register patches being formed once on the conveying belt, to thereby complete one control by plural number of times of formation.

(Second Embodiment)

Figure 5:
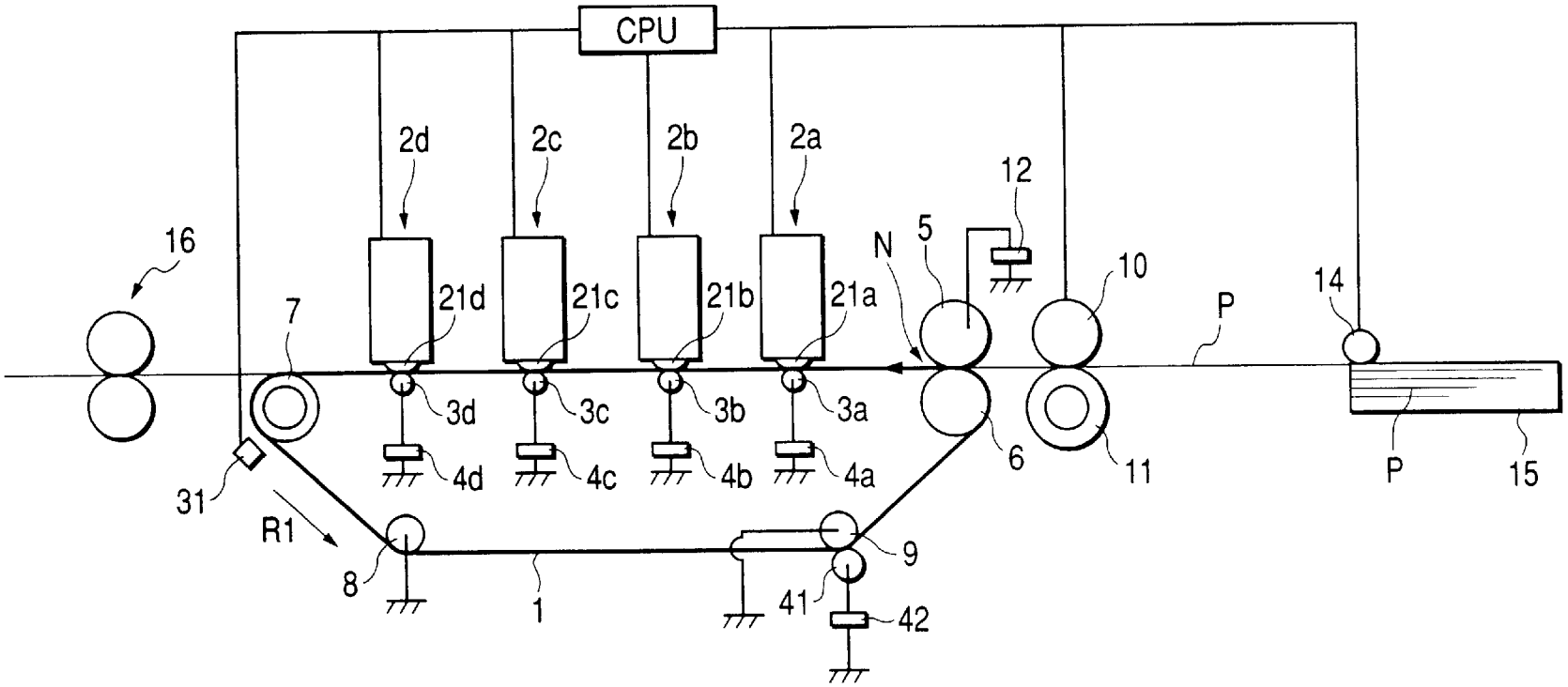
FIG. 5 is a schematic cross-sectional view showing an image forming apparatus in accordance with the present invention.

FIG. 5 is a schematic cross-sectional view showing an image forming apparatus in accordance with another embodiment of the present invention.

In order to more effectively electric-field clean the toner images of the density patches or the register patches on the conveying belt 1, it is preferable that the density patch is adjusted to a given polarity or size in advance before the electric field cleaning.

Accordingly, in this embodiment, a re-charging roller 41 is located at a portion of the conveying roller 1 where the tension roller 9 is disposed so as to nip the conveying belt 1 in cooperation with the tension roller 9. A bias is applied to the re-charging roller 41 from the bias power supply 42 so that the density patch or the register patch is re-charged before the density patch or the register patch on the normal charging polarity.

If the re-charging bias applied to the re-charging roller 41 is set to the bias of the same polarity as the normal charging polarity of the toner, since the toner of the contamination toner the polarity of which is reversed can be returned to the normal polarity, if the electric field cleaning is thereafter made as described in the first embodiment, a reference image during the normal printing operation can be excellently cleaned off, and also a reference image between sheets during the continuous printing operation can be excellently cleaned off. Also, it is difficult that the toner is stuck onto the re-charging roller 41 and the re-charging roller 41 is contaminated by the toner. As one example, when a bias voltage of about −1.5 kV is applied to the re-charging roller 41, an excellent result is obtained.

On the other hand, if the re-charging bias applied to the re-charging roller 41 is set to the bias of the polarity reverse to the normal charging polarity of the toner, since all of the polarities of the contamination toners on the conveying belt 1 can be reversed, the potentials of the respective photosensitive drum 2 are then maintained to a dark section potential (about −600 V) which is non-exposing section, and the contamination toner on the conveying belt 1 can be electrostatically collected into the photosensitive drum 2 while values conveying belt 1 which has been detected by the photosensor 31 reaches the transfer portion of the process station 2.

As the re-charging roller 41, there is preferably applicable a surface layer made of rubber or resin $10^6$ to $10^{12}$ Ωcm in volume resistivity and 50 to 300 μm in thickness which is coated on a base layer made of electrically conductive rubber $10^4$ to $10^6$ Ωcm in volume resistivity and 2 to 6 mm in thickness coated on a mandrel.

In this embodiment, as an example of the recharging roller 41, an electrically conductive rubber layer 3 mm in thickness is coated on a mandrel as a base layer, a medium-resistance layer about $10^6$ Ωcm in volume resistivity is coated on the electrically conductive rubber layer and a bonding prevention layer made of nylon resin or the like 10 μm in thickness on the medium-resistance layer as a surface layer. The mandrel is formed of a metal bar made of stainless steel (SUS), and an outer diameter of the re-charging roller is set to 12 mm.

The re-charging roller 41 is applicable to both of a case in which the density patch or the register patch is electrically charged with the same polarity as the normal charging polarity of the toner and a case in which the density patch or the register patch is electrically charged with the opposite polarity of the of the transfer biases applied to the respective rollers 3 are also maintained to the normal value during the transferring operation.

In this case, since a part of the contamination toner having the normal polarity is stuck onto the surface of the re-charging roller 41 without reversing the polarity, an additional cleaning sequence for cleaning the surface of the re-charging roller 41 may be provided so that the contamination toner is discharged from the re-charging roller 41 to the conveying belt 1 by the cleaning member or the application of positive/negative bias to the re-charging roller 41.

As another example of the bias for re-charging the toner which is applied to the re-charging roller 41, an a.c. voltage superimposed on a d.c. voltage (zero-cross alternating voltage) can be employed. With the above bias, the amount of charges given to the toner can be adjusted by changing the duty ratio of positive and negative of the alternating voltage (a ratio of a period of time during which the voltage at the positive polarity side is applied to one cycle of the a.c. voltage), and the toner can be prevented from being stuck onto the surface of the re-charging roller 41 by making the superimposed d.c. voltage small or zero (in this example, the d.c. voltage is set to a medium value of the upper and lower peaks of the alternating voltage).

Figure 6:
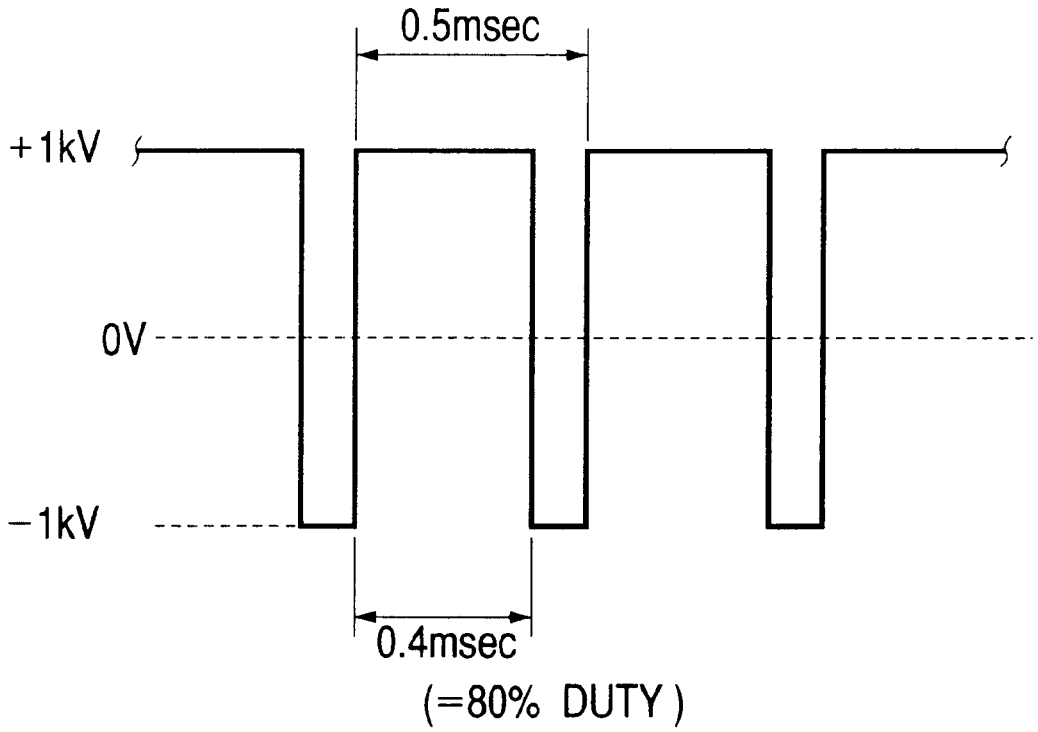
FIG. 6 is a waveform diagram showing an example of a bias which is applied to a re-charging roller.

More specifically, as shown in FIG. 6, as a result of applying a bias voltage of the alternating voltage 2 kHz in the frequency of the a.c. voltage, 2 kV in peak-to-peak voltage, 80% in duty ratio and 0 V in d.c. voltage to the re-charging roller 41, all of the polarities of the contamination toner on the conveying belt 1 can be reversed to the plus polarity, and also the toner can be prevented from being stuck onto the re-charging roller 41.

This may be because the plus charges are given to the toner in accordance with the duty ratio of the a.c. voltage whereas the surface potential on the conveying belt 1 is converged to the center value of the upper and lower peaks of the alternating voltage applied to the re-charging roller 41, that is, 0 V on the abutment portion of the re-charging roller 41 and is not adversely affected by the duty ratio.

It is preferable to make the duty ratio of the plus voltage applying period of time larger than 50% in the giving of the plus charges to the toner, and the charging can be further excellently conducted if the duty ratio is in a range of 60 to 90%. If the duty ratio is set to 10 to 40%, the minus charges which are the normal charging polarity of the toner are given to the contamination toner on the conveying belt 1, to thereby obtain substantially the same effect as that in the case of applying the minus d.c. bias to the re-charging roller 41 which was described in the beginning portion of this embodiment.

As described above, since the density patch or the register patch on the conveying belt 1 is electrically charged by the re-charging roller 41 before the density patch or the register patch is cleaned off, the density patch or the register patch on the conveying belt 1 can be surely cleaned off.

Since the operation sequence of the respective process means in this embodiment is the same as that described in the first embodiment shown in FIG. 3 and so on in the case of uniformly charging all of the contamination toner to minus, and therefore its description is omitted.

According to a method of reversing all of the contamination toner to plus polarity, since the transfer power supply 4*a* to 4*d* can be made up of only a power supply of applying the bias of one polarity (for example, in FIG. 3, all of the attractive biases between sheets and the transfer biases of the first to fourth colors can be set to the same plus bias value as that during the attracting operation or the transferring operation), the structure can be simplified. In addition, since the electric field cleaning can be executed without setting the potential of the photosensitive drum and the respective transfer bias values to special values, even if a charging memory or the like is formed on the photosensitive drum, the image is not damaged.

In the above-described second embodiment, the contamination toner on the conveying belt 1 is re-charged by the provision of the re-charging roller 41. Particularly, during the normal printing operation, in the case where the contamination toner on the conveying belt 1 is uniformed to the charging polarity of minus or plus, it is possible to apply the bias for re-charging to the attractive roller 5 instead of the re-charging roller 41.

Also, in the electric field cleaning in the case where the image is continuously formed on a plurality of transfer materials, if an alternating (vibrating) voltage making the duty ratio on the reverse polarity side of the charging polarity of the toner at a portion corresponding to a space between sheets larger than 50% is applied to the attractive roller 5, the re-charging roller 41 can be replaced by the above structure. In this case, as the attractive bias during the continuous printing operation, the transfer bias voltage of −1.5 kV or +1.5 kV may be applied in synchronism with the transfer material, and the same a.c. voltage as that applied in case of the space between sheets or the alternating voltage where that alternating voltage is superimposed on a d.c. voltage whose value is different from that in case of the space between sheets may be applied depending on the attractive state of the transfer material.

With the above structure, the re-charging roller 41 can be omitted in the second embodiment, and the structure can be simplified. In the case of using the attractive roller 5 that also serves as the re-charging roller, it is preferable that the structure of the attractive roller 5 is identical with the structure of the re-charging roller 41 described in the second embodiment.

Also, in the above first and second embodiments, since the conventional cleaning means dedicated to the conveying belt and its waste toner container can be omitted, the useability can be improved.

Figure 7:
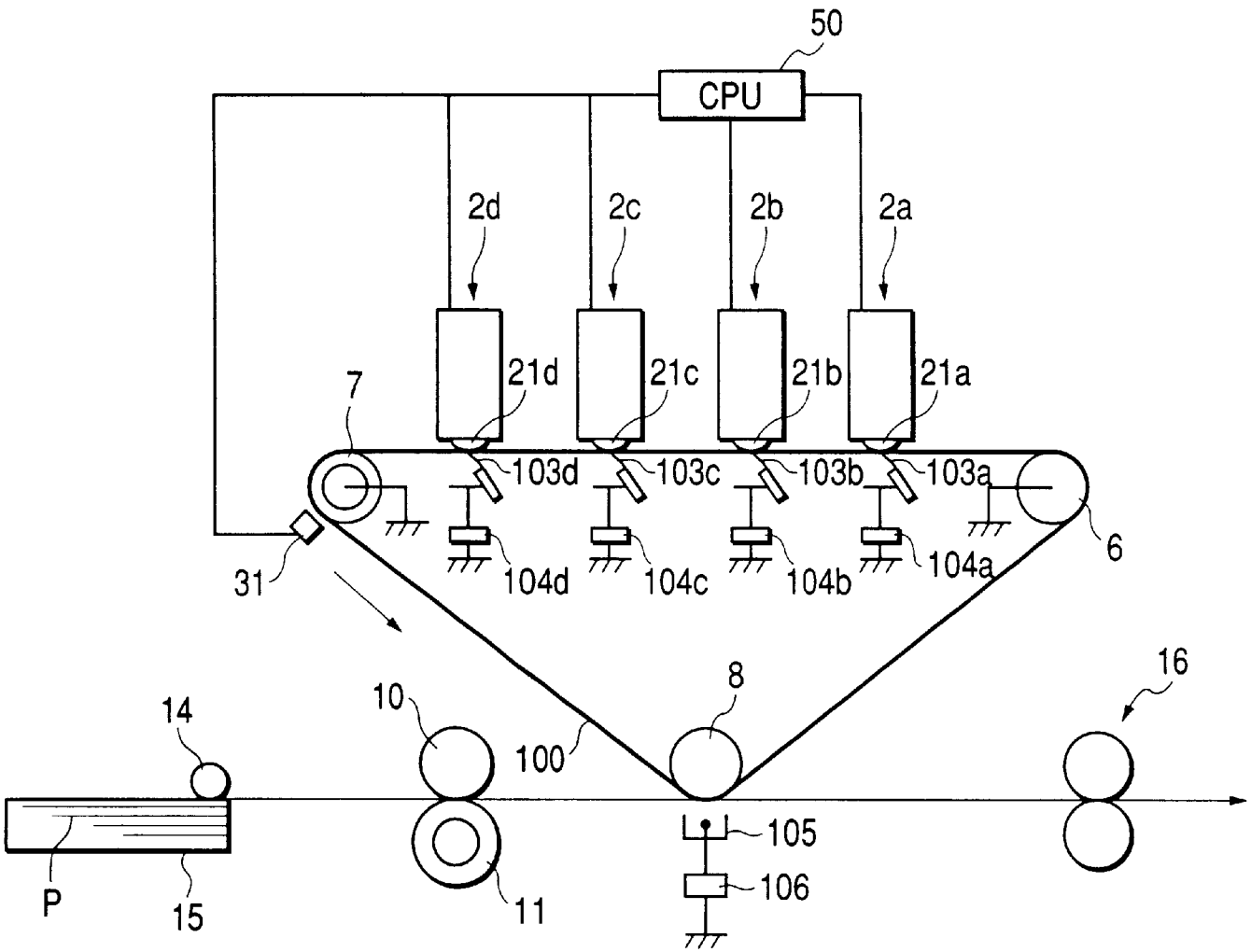
FIG. 7 is a schematic cross-sectional view showing an image forming apparatus in accordance with the present invention.

Also, in the above first and second embodiments, the description is given of the case in which the present invention is applied to the image forming apparatus that transfers the toner image on the photosensitive drum to the transfer material conveyed by the conveying belt. However, the present invention is similarly applicable to an image forming apparatus using an intermediate transfer member 100 shown in FIG. 7. In other words, if "the conveying belt" in the first and second embodiments is replaced by "intermediate transfer belt", and "space between sheets" is replaced by "space between images" which will be described below, it is easy to understand that the present invention can be applied to the image forming apparatus shown in FIG. 7, likewise. In FIG. 7, the same parts or functions as those in FIG. 1 are designated by identical symbols, and their detailed description will be omitted.

The image forming sequence of the image forming apparatus shown in FIG. 7 will be described in brief. The structure of the respective process stations is identical with that in FIG. 8, that is, identical with that of the first and second embodiments. The toner images of the respective colors formed on the respective photosensitive drums are sequentially superimposed and transferred on an intermediate transfer belt 100 as the intermediate transfer member by primary transfer rollers 103*a*, 103*b*, 103*c* and 103*d* at the respective primary transfer portions. The toner images of the respective colors on the intermediate transfer belt 100 is conveyed to a secondary transfer portion and then transferred onto the transfer material P collectively by applying a given voltage from a power supply 106 to a secondary transfer charger 105. Thereafter, the toner image is fixed onto the transfer material by a fixing device 16, to thus complete a permanent image of full colors.

Also, the residual toner that remains on the intermediate transfer belt after being secondarily transferred is conveyed onto the respective primary transfer portions and then electrically counter-transferred to the respective photosensitive drums 1 by the respective transfer rollers as in the above-described first and second embodiments. That is, no cleaning means dedicated to the intermediate transfer belt is provided as in the first and second embodiments.

Similarly, in the image forming apparatus thus structured, the density control mode and the registration control mode is executed.

As in the above-described first and second embodiments (the areas C and D in FIG. 3 may be replaced by the following spaces between images, and the areas A and B may be replaced by the image areas), in the case of continuously forming an image on a plurality of transfer materials, the density patch or the register patch is transferred between the adjacent image forming areas (areas between images) on the intermediate transfer belt from the photosensitive drum.

Then, in order to clean off the density patches or the register patches on the intermediate transfer belt, when the density patches or the register patches are conveyed onto the respective primary transfer portions by the intermediate transfer belt, a timing at which the toner image to be formed on the transfer material is formed on the intermediate transfer belt, that is, a timing at which the toner image to be formed on the transfer material is formed on the photosensitive drum (exposure (latent image formation) start timing) is controlled by a CPU 50 so that the above patches are not superimposed on the intermediate transfer belt. As a result, the image failure can be prevented from occurring by superimposing the toner image on the intermediate transfer belt which is to be formed on the transfer belt on the patches. Also, the CPU 50 controls the timing at which the toner image to be formed on the transfer material is formed on the intermediate transfer belt in accordance with the length (it may be replaced by the length of the transfer material in the conveying direction) of the image forming areas (corresponding to A and B in FIG. 3) in the moving direction of the intermediate transfer belt. With the above structure, it is effective, for example, when the above patches are formed on both of the areas C and D shown in FIG. 3.

In order to predict the position of the patches on the intermediate transfer belt, a period of time that elapses since the electrostatic latent image corresponding to the patch starts to be formed on the photosensitive drum (or the formation completion) as in the first embodiment is measured by a timer, and the timing at which the toner image to be formed on the transfer material is formed on the intermediate transfer belt is controlled by the CPU 50 on the basis of the measured period of time. Also, the present invention is not limited to this, the position of the patch on the intermediate transfer belt may be directly detected by a sensor to surely conduct the above control as in the first and second embodiments. The sensor may be formed of the photosensor 31.

Also, as in the second embodiment, the patch on the intermediate transfer belt is electrically charged to a given polarity by the re-charging roller, and thereafter the patch may be counter-transferred onto the respective photosensitive drums at the respective primary transfer portions by the respective transfer rollers. With the above structure, the patches can be excellently counter-transferred.

Since the mechanism for grasping the position of the patch on the intermediate transfer belt is identical with that in the above-described first and second embodiments except for above description, its description will be omitted. As described above, "conveying belt" in the first and second embodiments may be replaced by "intermediate transfer belt", and "space between sheets" in the first and second embodiments may be replaced by "space between images".

As was described above, the present invention can be applied to the image forming apparatus using the intermediate transfer member similarly, and the image failure can be prevented from occurring by superimposing the toner image on the intermediate transfer belt which is primarily transferred from the photosensitive drum for forming the toner image on the transfer material on the density patch or the register patch without lowering the through-put of the image formation.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

an image bearing member for bearing an image;

a transfer material bearing member for bearing and conveying a transfer material;

wherein an image on said image bearing member is transferred onto the transfer material borne on said transfer material bearing member at a transfer portion;

detecting means for detecting a detection image transferred from said image bearing member onto said transfer material bearing member;

wherein the detection image conveyed to said transfer portion by said transfer material bearing member after being detected by said detecting means is transferred onto said image bearing member; and control means for controlling a timing at which the transfer material is supplied to said transfer material bearing member based on information with respect to the detection image when a plurality of images are continuously formed on a plurality of transfer materials.

2. An image forming apparatus according to claim 1, wherein said control means controls the timing at which the transfer material is supplied to said transfer material bearing member so that the detection image is not superimposed on the transfer material.

3. An image forming apparatus according to claim 1 or 2, wherein said control means controls the timing at which the transfer material is supplied to said transfer material bearing member based on a length of the transfer material in a conveying direction of the transfer material.

4. An image forming apparatus according to claim 3, further comprising measuring means for measuring a period of time which elapses after the detection image is formed on said image bearing member;

wherein said control means controls the timing at which the transfer material is supplied to said transfer material bearing member based on the period of time measured by said measuring means.

5. An image forming apparatus according to claim 1 or 2, further comprising measuring means for measuring a period of time which elapses after the detection image is formed on said image bearing member;

wherein said control means controls the timing at which the transfer material is supplied to said transfer material bearing member based on the period of time measured by said measuring means.

6. An image forming apparatus according to claim 1 or 2, wherein said control means controls the timing at which the transfer material is supplied to said transfer material bearing member based on a timing at which the detection image on said transfer material bearing member passes through a predetermined position.

7. An image forming apparatus according to claim 6, wherein said detecting means detects the timing at which the detection image on said transfer material bearing member passes through said predetermined position.

8. An image forming apparatus according to claim 1 or 2, wherein the detection image of toner on said image bearing member is transferred onto said transfer material bearing member after a first transfer material passes through said transfer portion and before a second transfer material subsequent to the first transfer material reaches said transfer portion.

9. An image forming apparatus according to claim 1 or 2, further comprising transfer charging means for transferring the image on said image bearing member to the transfer material born on said transfer material bearing member;

wherein when the detection image is transferred from said transfer material bearing member to said image bearing member, a voltage of the same polarity as a charging polarity of the image is applied to said transfer charging means.

10. An image forming apparatus according to claim 1 or 2, further comprising collecting means for collecting the detection image transferred onto said image bearing member.

11. An image forming apparatus according to claim 10, wherein said collecting means comprising a blade which is in contact with said image bearing member for removing the detection image.

12. An image forming apparatus according to claim 1 or 2, wherein the transfer material can be born in any positions on said transfer material bearing member in a moving direction of said transfer material bearing member.

13. An image forming apparatus according to claim 1 or 2, wherein the detection image can be formed in any positions on said transfer material bearing member in a moving direction of said transfer material bearing member.

14. An image forming apparatus according to claim 1 or 2, wherein said control means controls a density of the image formed on said image bearing member based on a detected result of said detecting means, wherein the image is to be transferred onto the transfer material.

15. An image forming apparatus according to claim 1 or 2, comprising a plurality of image bearing members, wherein images of plural colors are sequentially superimposed and transferred from said plurality of image bearing members onto the transfer material born on said transfer material bearing member.

16. An image forming apparatus according to claim 15, wherein the detection image is transferred from each of said plurality of image bearing members onto said transfer material bearing member.

17. An image forming apparatus according to claim 16, wherein said control means controls a density of each of the images formed on said plurality of image bearing members based on a detected result of said detecting means, wherein the images are to be transferred onto the transfer material.

18. An image forming apparatus according to claim 16, wherein said control means controls timings at which the images are formed on said plurality of image bearing members based on a detected result of said detecting means, wherein the images are to be transferred onto the transfer material.

19. An image forming apparatus, comprising:

an image bearing member for bearing an image;

an intermediate transfer member;

wherein after an image on said image bearing member is transferred onto said intermediate transfer member at a transfer portion, the image on said intermediate transfer member is transferred onto a transfer material;

detecting means for detecting a detection image transferred from said image bearing member onto said intermediate transfer member;

wherein the detection image conveyed to said transfer portion by said intermediate transfer member after being detected by said detecting means is transferred onto said image bearing member; and control means for controlling a timing at which the image to be transferred onto the transfer material is formed on said intermediate transfer member based on information with respect to the detection image when a plurality of images are continuously formed on a plurality of transfer materials.

20. An image forming apparatus according to claim 19, wherein said control means controls the timing at which the image to be transferred onto the transfer material is formed on said intermediate transfer member so that the detection image is not superimposed on the image.

21. An image forming apparatus according to claim 19 or 20, wherein said control means controls the timing at which the image to be transferred onto the transfer material is formed on said intermediate transfer member based on a length of the image in a moving direction of said intermediate transfer member.

22. An image forming apparatus according to claim 19 or 20, wherein said control means controls the timing at which the image to be transferred onto the transfer material is formed on said intermediate transfer member based on a length of the transfer material in a conveying direction of the transfer material.

23. An image forming apparatus according to claim 22, further comprising measuring means for measuring a period of time which elapses after the detection image is formed on said image bearing member;

wherein said control means controls the timing at which the image to be transferred onto the transfer material is formed on said intermediate transfer member based on the period of time measured by said measuring means.

24. An image forming apparatus according to claim 19 or 20, further comprising measuring means for measuring a period of time which elapses after the detection image is formed on said image bearing member;

wherein said control means controls the timing at which the image to be transferred onto the transfer material is formed on said intermediate transfer member based on the period of time measured by said measuring means.

25. An image forming apparatus according to claim 19 or 20, wherein said control means controls the timing at which the image to be transferred onto the transfer material is formed on said intermediate transfer member based on a timing at which the detection image on said intermediate transfer member passes through a predetermined position.

26. An image forming apparatus according to claim 25, wherein said detecting means detects the timing at which the detection image on said intermediate transfer member passes through said predetermined position.

27. An image forming apparatus according to claim 19 or 20, wherein the detection image on said image bearing member is transferred onto said intermediate transfer member after an image to be transferred onto a first transfer material has been completely transferred from said image bearing member onto said intermediate transfer member and before another image to be transferred onto a second transfer material subsequent to said first transfer material is transferred from said image bearing member onto said intermediate transfer member.

28. An image forming apparatus according to claim 19 or 20, further comprising transfer charging means for transferring the image on said image bearing member onto said intermediate transfer member;

wherein when the detection image is transferred from said intermediate transfer member onto said image bearing member, a voltage of the same polarity as a charging polarity of the image is applied to said transfer charging means.

29. An image forming apparatus according to claim 19 or 20, further comprising collecting means for collecting the detection image transferred onto said image bearing member.

30. An image forming apparatus according to claim 29, wherein said collecting means comprising a blade which is in contact with said image bearing member for removing the detection image.

31. An image forming apparatus according to claim 19 or 20, wherein the image can be transferred to any positions on said intermediate transfer member in a moving direction of said intermediate transfer member.

32. An image forming apparatus according to claim 19 or 20, wherein the detection image can be transferred to any positions on said intermediate transfer member in a moving direction of said intermediate transfer member.

33. An image forming apparatus according to claim 19 or 20, wherein said control means controls a timing at which the image to be transferred to the transfer material is formed on said image bearing member.

34. An image forming apparatus according to claim 19 or 20, wherein said control means controls a density of the image formed on said image bearing member based on a detected result of said detecting means, wherein the image is to be transferred onto the transfer material.

35. An image forming apparatus according to claim 19 or 20, comprising a plurality of image bearing members, wherein images of plural colors are sequentially superimposed and transferred from said plurality of image bearing members onto the transfer material born on said intermediate transfer member.

36. An image forming apparatus according to claim 35, wherein the detection image is transferred from each of said plurality of image bearing members onto said intermediate transfer member.

37. An image forming apparatus according to claim 36, wherein said control means controls a density of each of the images formed on said plurality of image bearing members based on a detected result of said detecting means, wherein the images are to be transferred onto the transfer material.

38. An image forming apparatus according to claim 36, wherein said control means controls the timing at which the images are formed on said plurality of image bearing members based on a detected result of said detecting means, wherein the images are to be transferred onto the transfer material.

* * * * *

UNITED STATES PATENT AND TRADEMARK OFFICE

CERTIFICATE OF CORRECTION

PATENT NO. : 6,427,062 B1
DATED : July 30, 2002
INVENTOR(S) : Akihiko Takeuchi

It is certified that error appears in the above-identified patent and that said Letters Patent is hereby corrected as shown below:

Title page,
Item [57], ABSTRACT,
Line 7, “born” should read -- borne --.

Column 1,
Line 29, “born” should read -- borne --.

Column 2,
Line 25, “born” should read -- borne --; and
Line 27, “born” should read -- borne --.

Column 3,
Line 20, “sized” should read -- size --.

Column 6,
Line 24, “born” should read -- borne --; and
Line 57, “born” should read -- borne --.

Column 9,
Line 52, “born” should read -- borne --.

Column 10,
Line 15, “born)” should read -- borne) --;
Line 16, “born)” should read -- borne) --;
Line 19, “born” should read -- borne --;
Line 29, “born” should read -- borne --;
Line 31, “born” should read -- borne --;
Line 40, “bias=+1.5 kV” should read -- bias = +1.5 kV --;
Line 42, “bias=-1.5 kV” should read -- bias = -1.5 kV --;
Line 45, “bias=+1.5 kV” should read --bias = +1.5 kV --;
Line 48, “bias=-1.5 kV” should read -- bias = -1.5 kV --;
Line 53, “bias=+1.5 kV” should read -- bias = +1.5 kV --; and
Line 54, “bias=-1.5 kV” should read -- bias = -1.5 kV --.

Column 11,
Line 4, “born” should read -- borne --; and
Line 6, “born” should read -- borne --.

UNITED STATES PATENT AND TRADEMARK OFFICE

CERTIFICATE OF CORRECTION

PATENT NO. : 6,427,062 B1
DATED : July 30, 2002
INVENTOR(S) : Akihiko Takeuchi

It is certified that error appears in the above-identified patent and that said Letters Patent is hereby corrected as shown below:

Column 12,
Line 49, "bias=-1.5 kV" should read -- bias = -1.5 kV --.

Column 13,
Line 9, "on the normal" should read -- on the conveying belt 1 which has been detected by the photosensor 31 reaches the transfer portion of the process station 2.

As the re-charging roller 41, there is preferably applicable a surface layer made of rubber or resin $10^6$ to $10^{12}$ Ωcm in volume resistivity and 50 to 300 $\mu$m in thickness which is coated on a base layer made of electrically conductive rubber $10^4$ to $10^6$ Ωcm in volume resistivity and 2 to 6 mm in thickness coated on a mandrel.

In this embodiment, as an example of the re-charging roller 41, an electrically conductive rubber layer 3 mm in thickness is coated on a mandrel as a base layer, a medium-resistance layer about $10^6$ Ωcm in volume resistivity is coated on the electrically conductive rubber layer and a bonding prevention layer made of nylon resin or the like 10 $\mu$m in thickness on the medium-resistance layer as a surface layer. The mandrel is formed of a metal bar made of stainless steel (SUS), and an outer diameter of the re-charging roller is set to 12 mm.

The re-charging roller 41 is applicable to both of a case in which the density patch or the register patch is electrically charged with the same polarity as the normal charging polarity of the toner and a case in which the density patch or the register path is electrically charged with the opposite polarity of the normal --;
Line 33, "conveying belt 1 which has been detected by the" should be deleted;
Lines 34 through 56, should be deleted; and
Line 57, "polarity of the" should be deleted.

Column 18,
Line 24, "born" should read -- borne --;
Line 35, "comprising" should read -- comprises --;
Line 39, "born" should read -- borne --; and
Line 55, "born" should read -- borne --.

UNITED STATES PATENT AND TRADEMARK OFFICE

CERTIFICATE OF CORRECTION

PATENT NO. : 6,427,062 B1
DATED : July 30, 2002
INVENTOR(S) : Akihiko Takeuchi

It is certified that error appears in the above-identified patent and that said Letters Patent is hereby corrected as shown below:

Column 20,
Line 25, "comprising" should read -- comprises --; and
Line 49, "born" should read -- borne --.

Signed and Sealed this

Twenty-fourth Day of December, 2002

JAMES E. ROGAN
*Director of the United States Patent and Trademark Office*